US005548943A

United States Patent [19]

Behar et al.

[11] Patent Number: 5,548,943

[45] Date of Patent: Aug. 27, 1996

[54] METHOD FOR ASSEMBLING DISPENSER WITH PLUNGING SLEEVE

[75] Inventors: Alain Behar, EU; Pierre Amiel, Neuilly sur Seine; Jean-Louis Bougamont, EU, all of France

[73] Assignee: SOFAB, Suresnes, France

[21] Appl. No.: 373,808

[22] Filed: Jan. 17, 1995

Related U.S. Application Data

[62] Division of Ser. No. 60,781, May 12, 1993, Pat. No. 5,449, 094.

[30] Foreign Application Priority Data

May 18, 1992 [FR] France ..... 92 05978
Jul. 24, 1992 [FR] France ..... 92 09114

[51] Int. Cl.[6] ..... B65B 7/28

[52] U.S. Cl. ..... 53/473; 53/489

[58] Field of Search ..... 53/473, 485, 488, 53/489; 222/321, 385, 386, 387; 29/469, 525, 888.02

[56] References Cited

U.S. PATENT DOCUMENTS

| | | | |
|---|---|---|---|
| 2,992,052 | 7/1961 | De John | 222/386 X |
| 3,129,854 | 4/1964 | Boehm et al. | 222/321 |
| 3,596,808 | 8/1971 | Corsette | 222/385 X |
| 3,897,672 | 8/1975 | Scheindel | 53/489 X |
| 4,402,431 | 9/1983 | Wiegner et al. | 53/489 X |
| 4,728,008 | 3/1988 | Graf et al. | 222/321 |
| 4,809,887 | 3/1989 | Jupin et al. | 53/489 |
| 4,817,829 | 4/1989 | Fuchs et al. | 222/259 |
| 4,819,836 | 4/1989 | Meckenstock | 53/489 X |
| 5,035,106 | 7/1991 | Haase | 53/488 X |
| 5,037,009 | 8/1991 | Shea | 222/386 |
| 5,083,416 | 1/1992 | Schneider et al. | 53/489 |
| 5,085,350 | 2/1992 | Sugita | 222/386 X |

FOREIGN PATENT DOCUMENTS

| | | | |
|---|---|---|---|
| 0446513 | 9/1991 | European Pat. Off. | B05B 11/02 |
| 2668082 | 4/1992 | France | B05B 11/02 |

*Primary Examiner*—W. Donald Bray
*Assistant Examiner*—Daniel Moon
*Attorney, Agent, or Firm*—Pennie & Edmonds

[57] ABSTRACT

This invention has as its subject a dispensing device for fluid-like products, composed of a container having a cylindrical drum, of which one end is provided with a movable base and the other end includes a neck which is capped by a distributor assembly including a pump with axial intake which is fitted onto a plunger sleeve. The lower face of the sleeve penetrates into the neck of the container during the fixing of the distributor assembly in the neck of the container, coming into position in sliding sealing engagement with a bearing surface of the neck.

7 Claims, 2 Drawing Sheets

METHOD FOR ASSEMBLING DISPENSER WITH PLUNGING SLEEVE

This is a division, of application Ser. No. 08/060,781, filed May 12, 1993 U.S. Pat. No. 5,449,094.

BACKGROUND OF THE INVENTION

Dispensers for more or less fluid products are known, formed of a casing having a cylindrical drum, of which one end, usually its lower end, is provided with a movable base normally retained by some kind of ring, and which is capped at the opposite end by a distributor pump with axial intake. Atmospheric pressure causes the base to ascend progressively as the product is removed by the pump. This both enables the paste or cream, or indeed liquid, to be sheltered from the air and allows them to be methodically expelled during use.

The components are, with advantage, moulded parts suitable for assembling together by simple fitting into one another.

Such a dispenser may be designed so that it is filled when upside down before the base is fitted, but it appears more advantageous to operate in the normal position, finishing with the mounting of the pump. The simplest approach for the packager is then to inject the product into the casing already provided with its base, and to then close the container in one operation by fitting a distributor sub-assembly, comprising a pump entirely assembled onto a leaktight sleeve for reduction in diameter.

This sleeve comprises a seating forming the bottom part of the distributor pump, or intended for receiving it, and traversed by the intake orifice, and a diaphragm which connects this seating to the receptacle, capping the latter to create inside it a funnel-shaped roof, the shape of which corresponds to the shape of the movable base, which eliminates losses of product. The roof may carry a well which will receive the pump body.

A disadvantage is, however, that it becomes difficult to eliminate the presence of a pocket of air capable of depriming the pump or at least of interfering with its proper functioning.

SUMMARY OF THE INVENTION

The invention proposes to eliminate the disadvantages of the prior constructions by giving to the sealing sleeve the form of a plunger, the front face of which will penetrate slideably into the neck during the fixing of the distributor assembly, becoming entirely situated below the upper edge of the corresponding bearing area of said neck.

Whatever the consistency of the product may then be, it thus becomes possible to fill the casing with a sufficient amount of the product for this product subsequently, during closure, to be forced back by means of the sealing sleeve so as to complete the expulsion of the air from the receptacle towards the body of the pump, making use of the intentional or spontaneous opening of the inlet valve to this pump and, possibly also, when the structure of the pump allows this, to discharge this air at least partly through the opening of its outlet valve.

It is advisable for this face to form a sufficiently sloping roof, inclined in principle at least 20°, to prevent bubbles of air sticking to its face.

Advantageously, the sealing action will come into play only at the end of the stroke, on either side of a dead space, to which to the sleeve will previously have expelled a portion of the air and of the product.

BRIEF DESCRIPTION OF THE DRAWINGS

These characteristics will be explained below by the description of advantageous examples, with reference to the drawings of which.

DETAILED DESCRIPTION OF THE INVENTION

Figure 1A:
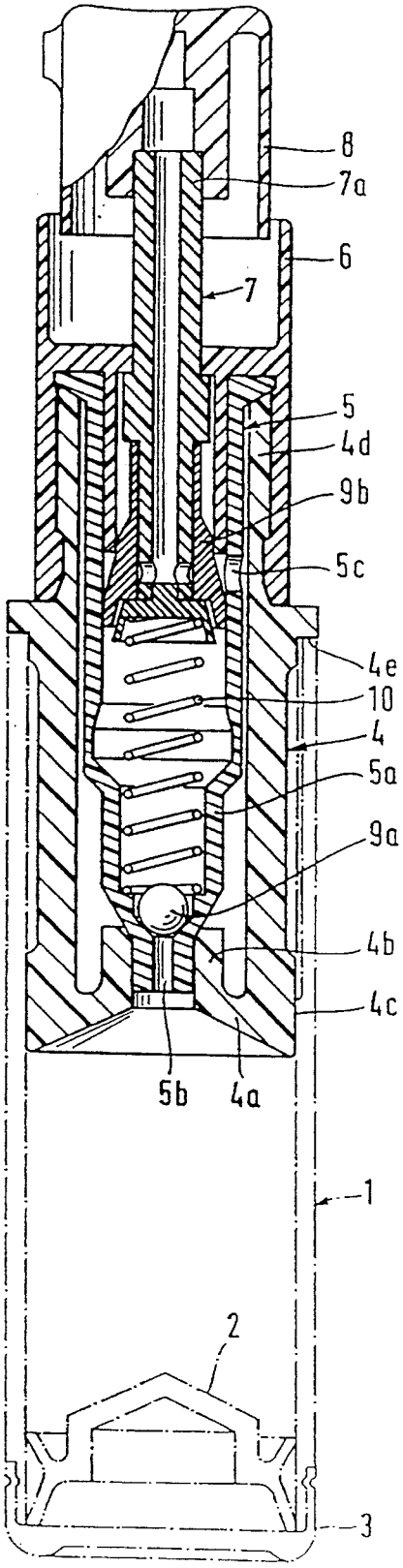
FIGS. 1A and 1B are longitudinal sections through an upper and a lower sub-assembly, respectively, of a dispenser in course of manufacture.
Figure 1B:
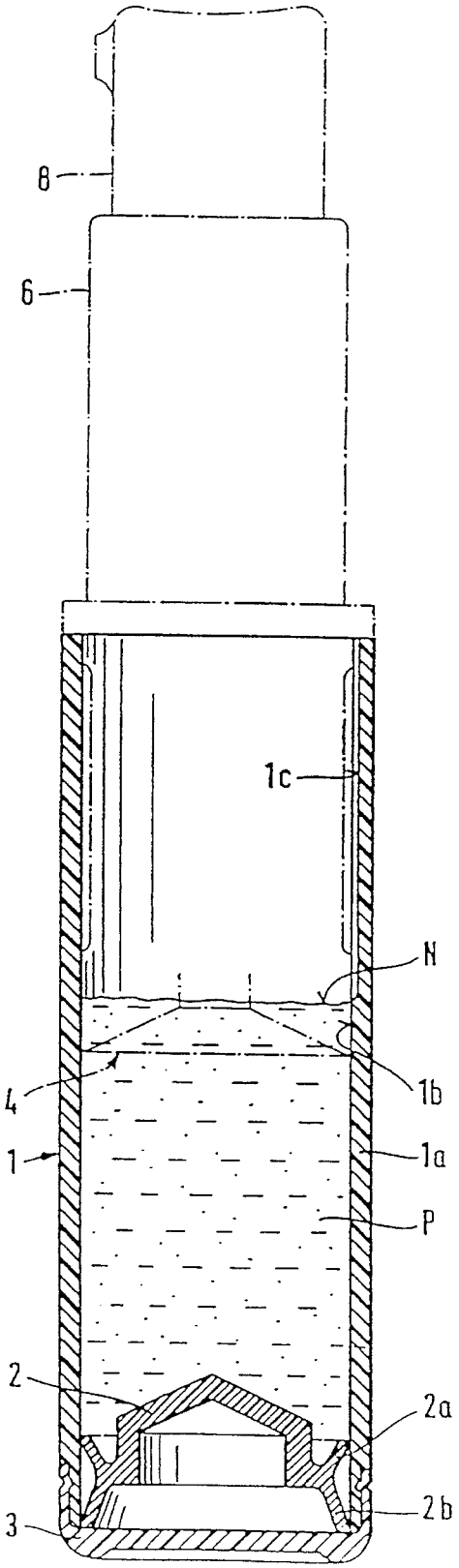

The dispenser shown in FIG. 1A and 1B comprises a casing 1 having a drum 1*a*, cylindrical but not necessarily circular, housing a piston 2 of the same contour, which serves as movable base; this piston is retained by a ring 3, which may range from a simple projection or circlip to a double-bottom allowing an entry for air. This sub-assembly B forms as a whole the container.

The movable base 2 preferably has two lips 2*a* and 2*b*, pointing in opposite directions. The lip 2*a*, which is set back from its upper face, serves essentially as a scraper during the upward movement under the effect of the suction created by the pump, preventing any non-uniformity of consistency and behavior of the product from lifting the lip 2*b* which, for its part, serving essentially for preventing any inlet of air through the base, fulfills the principal function and forms the sealing lip proper.

A sleeve 4 houses the distributor pump 5. Its body 5*a* is closed by its collar 6, which retains the piston 7, the piston-rod 7*a* of which forms a nozzle stem carrying a head 8 serving as pusher and provided with a suitable nozzle. This sub-assembly A forms the distributor.

In known manner, the pump has a ball inlet valve 9*a* and a sliding sleeve outlet valve 9*b*. At rest, the piston 7, which is biased upwards by its spring 10, also makes a seal against the collar 6 by the way of the sleeve 9*b*.

The diaphragm 4*a* of the sleeve 4 carries a central orifice bordered by a seating 4*b*, against which the lower end of the pump, where its intake 5*b* is located, fits in sealing manner during assembling, an outer bearing face 4*c* and a well in which the body 5*a* is housed, its flange 4*d* finally fixing the pump by means of its collar 6.

The conical lower face of the diaphragm 4*a* leads as a funnel towards its orifice; in the axis of which the pump is situated; during assembling of the two sub-assemblies, it will create the roof of the container; the profile of the movable base 2 corresponds to it, in such a way as to prevent losses of product at the end of use. If the pump is provided with a vent 5*c*, this vent will be neutralized by the sleeve 4, which will thus keep the reservoir of product P protected from the air.

The sleeve is adapted to be fitted onto the casing 1 to close it at its upper part, while a shoulder 4*e* may advantageously arrest it as a stop or teeth may hold it on a flange of the neck.

According to this invention, its outer lateral wall face slides here in the manner of a plunger, in a sealed manner at the end of the stroke along a corresponding internal bearing surface 1*b* over a distance sufficient to bring the intake below the upper edge of this bearing surface, but while it is in the upper part, passages 1*c* initially allow escape of the air. An excess of air and also of liquid product may be discharged to an intermediate dead space along the external bearing face of the sealing sleeve.

This form of construction enables all of the components to be produced by injection moulding and, with advantage, to be assembled by fitting them into or onto one another.

The product P, for the purpose of charging it into the apparatus, is placed in the casing 1 in a quantity corresponding accurately to the desired dose, rising to a more or less uniform level depending upon its viscosity, close to a mean level N. During the fitting on of the upper sub-assembly, the sleeve 4 will expel the air to the outside and then, forming a seal, will expel to the pump the portion of air remaining trapped, lifting the inlet valve 9*a*; its lower face then reaching the product, it will expel to the intake 5*b* the portion initially remaining outside in relation to the final position of the funnel cone, approximately equal in volume to the internal volume of the pump, thus compelling the pump to be at least partly filled with product to facilitate its priming. It therefore compresses the air there and will even partly expel it to the outside against the resistance of the sleeve 9*b* if care has been taken to press hard on the piston, which may already be equipped with its head 8, in order to release the escape.

Figure 2:
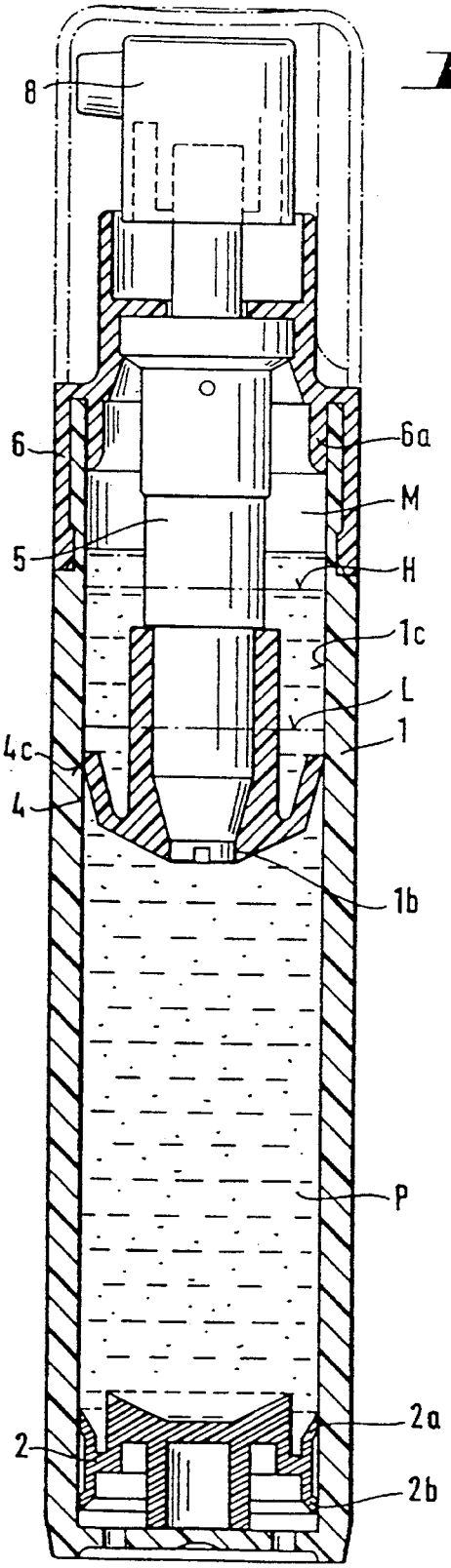
FIG. 2 is a longitudinal section of another embodiment of the dispenser.

FIG. 2 shows with the same references a form of embodiment in which the body of an analogous pump 5 is only fitted into its collar 6 which, on the other hand, itself serves as a reduction ring for fixing the distributor sub-assembly onto the neck of the container 1, whereas the sealing sleeve 4 is simply pushed on as a friction fit onto the lower part of the body of the pump 5.

This solution is more advantageous in several respects. In the first place, the construction of the components is simpler. It will also be seen that there exists along the body of the pump, masked by the collar, a dead space M having a volume of the order of five times the internal volume of the pump, and that the passage 1*c* is formed by an inner bore of increased diameter, which a lip 6*a* of this collar will close in sealed manner on completion of the assembling operation.

In fact, the process of filling described in relation to the version shown in FIG. 1 assumes that the relative tolerance to the quantity of product introduced into the casing 1 shall be less than the internal volume of the pump, or one dose, since it is not desirable that, from the start of the filled condition, this product shall penetrate into the head 8 and even overflow out of the distribution nozzle; now such a condition is one of the most difficult to satisfy in large-scale production, carried out at a high rate. If a minimal margin of error of the order of three doses is assumed, the level N will vary between a minimum level L close to the opening-out of the wall face 1*b*, but still capable of supplying good priming to the pump, and a maximum level H situated higher up.

During filling the product will thus, in its turn, by the action of the sections offered and the respective counter-pressures, first invade a notable part of the dead space M. If the level L is itself higher than the top edge of the wall face 1*b*, the useful product capacity will be fixed accurately by coming into sealing of the sleeve 4, the excess being lost but remaining enclosed within the cartridge.

It will be noted also that it is then possible, as shown in the figure, to invert the cone defined by the front face of the sleeve without risk of leaving an air bubble at its upper part, which reduces slightly the quantity of collected air towards the pump.

Finally, it is not forbidden, at the cost of a certain loss of accuracy on the quantity of occluded air and therefore on the useful capacity, to dispense with the presence of any internal offset or diameter change creating a passage above the sealing area 1*b*, and to give only to the skirt which supports the outer bearing face 4*c* of the sleeve 4 adequate flexibility so that, while leaktight principally against external excess pressures, it allows during filling the escape of air, then of excess product, into the dead space under the effect of their temporary but appreciable compression.

Figure 3:
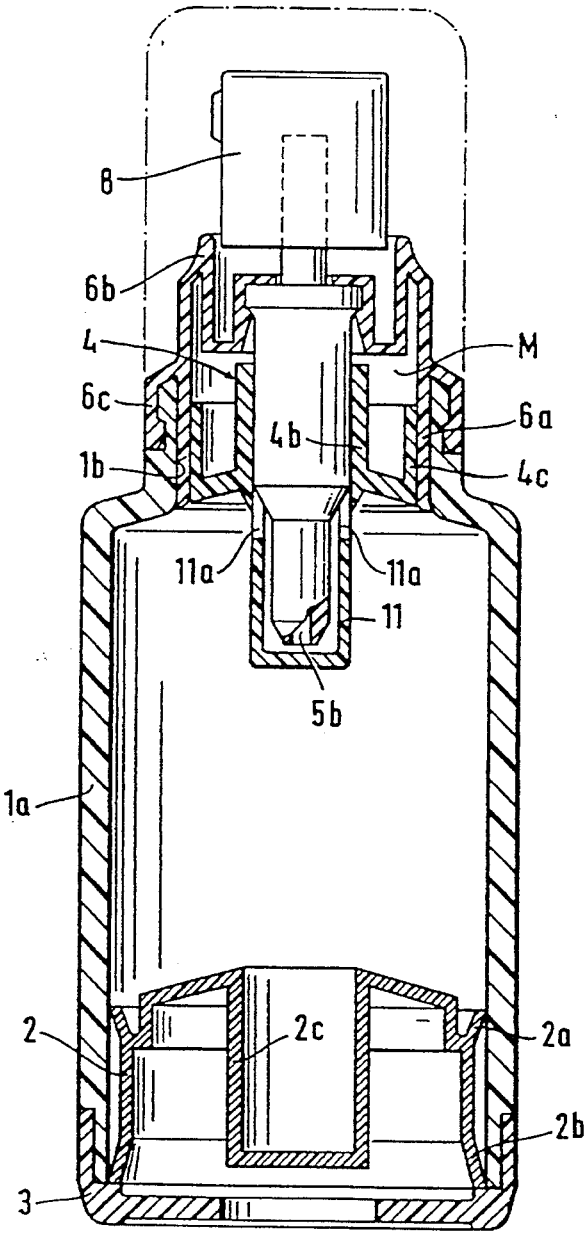
FIG. 3 is a longitudinal section of still another embodiment of the dispenser.

To reduce the overall height while continuing to use a standard pump with axial nozzle and intake, it will sometimes be possible to raise both the roof formed by the diaphragm of the sealing plunger sleeve and the effective level of the intake, by creating a siphon by means of an inverted bell fitting over the lower end of the pump body. Such a form of construction is shown in FIG. 3.

The casing 1 is provided with a drum having a cylindrical wall 1*a*, with a neck having a narrowed internal bearing area 1*b* and a movable base 2, fitted from the bottom.

The collar 6, which closes the pump 5, is folded back into a keeper ring 6*b* before being stepped out as a skirt 6*c*, which serves for fixing the pump onto the neck 1*b*, the internal lip 6*a* reinforcing the seal against the neck; it again thus serves as a reduction ring and fixing ring.

The sleeve 4 connects internally, in sealed manner with regard to external positive pressures, along its two bearing areas 4*b* and 4*c*, the body of the pump 5 to the neck 1*b*, in the present case by means of the lip 6*a*, against which it bears. Thus forming the roof of the container, it again constitutes a plunger ring adapted for expelling air from the container by simple pushing-in at the end of filling; but being sleeved at the top onto the body of the pump 5, its front face is on this occasion clearly above the lower end and the intake 5*b* of this pump.

The pump 5, in its narrowest part containing the return spring for its internal piston, is capped by a bell 11, which brings up to the apex of the roof the effective level where, through apertures 11*a*, the intake of product to the pump takes place through a siphon.

In variants, this bell could equally well form part of the pump body as serve itself for fixing the pump to the container, but it is preferable to use separate components, in order not to need to multiply the number of moulds of complex shape according to the intended uses. This also makes it possible, conversely, depending upon the current example, to form in one piece the scavenging plunger 4 and its siphon bell 11, instead of fixing this bell onto the pump by relief elements which even become superfluous for its centering; all the components are still suitable for production by injection moulding, the sleeve and bell forming a part of telescopic shape, the apertures being placed at their junction.

In order to avoid any loss of material, the movable base 2 should, of course, have a profile geometrically similar to that of the upper part of the container. It is very easy to do this by placing a basin 2*c* at the center of the band which carries the air sealing lip 2*b* and the scraper lip 2*a*.

We claim:

1. The method for assembling a dispenser with liquid product, said dispenser comprising a cylindrical drum and a distributor pump assembly, said drum having a wall, said wall having an upper part and an internal bearing surface, and said assembly comprising a sealing sleeve, said sealing sleeve housing a pump, said pump having a normally closed intake valve, said method comprising the steps of:

providing said upper part of said drum wall with an air escape passage (1*c*);

filling the drum with liquid product to a predetermined level;

inserting said assembly into the drum with an outer bearing face (4*c*) of said assembly slideably engaging said upper part and forcing a first portion of air out of said drum via said escape passage (1*c*) during said insertion; and moving said assembly further into the drum, with said outer bearing face (4*c*) forming a seal with said internal bearing surface (1*b*) of said drum wall, and until a lower face (4*a*) of said assembly contacts a surface of said liquid product; and forcing open said intake valve by continuing the moving of said assembly into said drum and moving said lower face (4*c*) into said liquid product to force a second portion of air and a quantity of liquid product into said pump.

2. The method for assembling a dispenser with liquid product, said dispenser comprising a cylindrical drum and a distributor pump assembly, said drum having a wall, said wall having an upper part and an internal bearing surface, said assembly comprising a pump and a sealing sleeve, said pump having a normally closed intake valve, said method comprising the steps of:

providing said assembly with a flexible skirt (4*c*);

filling the drum with liquid product to a predetermined level; and inserting said assembly into the drum with said flexible skirt slideably engaging said wall until a lower face (4*a*) of said assembly comes into contact with a surface of said liquid product and then moves into said liquid product to force air and then a portion of liquid product contained in said drum past said flexible skirt.

3. The method for assembling a dispenser with liquid product, said dispenser comprising a cylindrical drum and a distributor pump assembly, said drum having a wall, said wall having an upper part and an internal bearing surface, said assembly comprising a pump and a sealing sleeve, said pump having a normally closed intake valve, said method comprising the steps of:

providing said assembly with a flexible skirt (4*c*);

filling the drum with liquid product to a predetermined level; and inserting said assembly into the drum with said flexible skirt slideably engaging said wall until a lower face (4*a*) of said assembly comes into contact with a surface of said liquid product and then moves into said liquid product to force air and then a portion of liquid product contained in said drum between said flexible skirt and said wall; and sealing the dispenser with a reduction ring member; and moving said air and said portion of liquid product into an intermediate dead space between said assembly and said upper part.

4. The method for assembling a dispenser with liquid product, said dispenser comprising a cylindrical drum and a distributor pump assembly, said drum having a wall, said wall having an upper part, and said assembly comprising a sealing sleeve and a pump, said pump having a normally closed intake valve, said method comprising the steps of:

providing at least one of said upper part of said drum and said assembly with an air escape passage;

filling the drum with liquid product to a predetermined level;

inserting said assembly into the drum with said assembly slideably engaging said upper part and forcing air out of said drum via said escape passage during said insertion;

moving said assembly further into the drum until a lower face of said assembly contacts a surface of said liquid product; and forcing open said intake valve by continuing the moving of said assembly into said drum and moving said lower face into said liquid product to force a quantity of liquid product into said pump.

5. The method for assembling a dispenser with liquid product, said dispenser comprising a drum and a distributor pump assembly, said drum having a wall, said wall having an upper part, and said assembly comprising a sealing sleeve and a pump, said pump having a normally closed intake valve, said method comprising the steps of:

providing at least one of said upper part of said drum and said assembly with an escape passage;

filling the drum with liquid product to a predetermined level;

inserting said assembly into the drum with said assembly slideably engaging said upper part and forcing a first portion of air out of said drum via said escape passage;

moving said assembly further into the drum until a lower face of said assembly contacts a surface of said liquid product;

moving said assembly still further into said liquid product to force a first quantity of said liquid product above said lower face into a space along an external bearing face of said sealing sleeve; and forcing open said intake valve by continuing the moving of said assembly into said drum and moving said lower face into said liquid product to force a second portion of air and then a second quantity of liquid product into said pump.

6. The method of claim 5 comprising the further step of:

fitting one end of said drum with a movable base, said base being slideably engaged to said wall and arranged to move in an axial direction along said wall in a direction away from said one end, said movable base being fitted before the step of filling said drum with said liquid product to said predetermined level.

7. The method of claim 5 wherein said first quantity of liquid is sealed in an intermediate dead space between said sleeve and said wall.

* * * * *